US006739061B1

(12) United States Patent
Montel

(10) Patent No.: US 6,739,061 B1
(45) Date of Patent: May 25, 2004

(54) AUTOMATIC CAN OPENER

(76) Inventor: Sherry L. Montel, 63344 U.S. Hwy. 31, South Bend, IN (US) 46614-9515

( * ) Notice: Subject to any disclaimer, the term of this patent is extended or adjusted under 35 U.S.C. 154(b) by 14 days.

(21) Appl. No.: 10/241,856

(22) Filed: Sep. 13, 2002

(51) Int. Cl.[7] ..... B67B 7/46

(52) U.S. Cl. ..... 30/403; 30/405; 30/423; 30/433; 30/442

(58) Field of Search ..... 30/403, 401, 436, 30/400, 405, 416, 421, 423, 433, 434, 442

(56) References Cited

U.S. PATENT DOCUMENTS

| | | | | | |
|---|---|---|---|---|---|
| 613,076 | A | * | 10/1898 | Raymond | 30/436 |
| 3,045,617 | A | | 7/1962 | Dieter et al. | |
| 3,739,472 | A | * | 6/1973 | Peres | 30/403 |
| 3,740,840 | A | * | 6/1973 | McLaren et al. | 30/403 |
| 3,858,313 | A | * | 1/1975 | Yamaguchi | 30/404 |
| 3,878,604 | A | * | 4/1975 | Smith | 30/423 |
| 4,028,805 | A | * | 6/1977 | Figlia | 30/403 |
| 4,125,941 | A | | 11/1978 | McKinley | |
| 4,561,182 | A | * | 12/1985 | Yamamoto et al. | 30/433 |
| 4,648,183 | A | | 3/1987 | Jacobs | |
| 4,831,735 | A | * | 5/1989 | Bast et al. | 30/433 |
| 4,934,055 | A | | 6/1990 | Chambers | |
| D343,341 | S | | 1/1994 | Liner | |
| 5,664,333 | A | | 9/1997 | Hardman | |
| 6,092,292 | A | * | 7/2000 | Molnar et al. | 30/410 |
| 6,158,130 | A | * | 12/2000 | Chong | 30/418 |
| 6,279,236 | B1 | * | 8/2001 | Brady et al. | 30/410 |

* cited by examiner

*Primary Examiner*—Allan N. Shoap
*Assistant Examiner*—Phong Nguyen
(74) *Attorney, Agent, or Firm*—Donald R. Schoonover

(57) ABSTRACT

A can opener that automatically opens a can and then signals when the can has been opened, upon the insertion of a can into the can opener and pressing a start button. The automatic can opener is useful for physically challenged individuals and/or individuals who are sight challenged.

3 Claims, 2 Drawing Sheets

AUTOMATIC CAN OPENER

BACKGROUND OF THE INVENTION

1. Field of the Invention

The present invention relates to the general art of kitchen appliances, and to the particular field of can openers.

2. Discussion of the Related Art

Metal cans are ubiquitous in modern society. Metal cans are used to store a multitude of items, including food as well as other items. All of these cans are used to ensure proper storage of the various items because of the secure nature of the sealing possible with metal cans. However, due to the secure nature of the sealing, it may be difficult to open a metal can. A can opener is often used for that purpose.

Can openers have been used for many years and take many forms, including a simple hand operated knife type device, a hand operated rotating knife device, handle operated devices, and the like. One thing that all of these can openers have in common is the need for some manual dexterity on the part of the user. Often, the user must hold the can in one hand and operate the can opener with the other hand. While this may sound elementary, it can be quite difficult, if not impossible, for a physically challenged person, such as one who has arthritis or who is sight-impaired. Such people may not be able to operate a can opener in the manner intended by a designer.

Furthermore, if a person is sight-impaired, he or she may have to actually feel the blade of a can opener with his or her finger to determine where to place the can to be opened. This is not desirable, since it is preferable that a person not be required to touch the opening blade, especially one that may have been used to open a can of food. Such physically challenged people often require the assistance of another person to perform the simple task of opening a can.

Therefore, there is a need for a can opener that can be manipulated by someone who is physically challenged.

The art does contain many examples of automatic can openers. However, these known automatic can openers are not easily manipulated by a physically challenged user. Even these automatic can openers often require a user to hold a can in a certain position and then fit the can against the opening blade and hold the can or manipulate the opener to open the can. Again, while this may sound elementary to some, it may be difficult if not impossible for someone who is physically challenged.

Therefore, there is a need for an automatic can opener that can automatically set a can with respect to a can opening knife without requiring the user to either manipulate the can or contact the blade.

PRINCIPAL OBJECTS OF THE INVENTION

It is a main object of the present invention to provide an automatic can opener.

It is another object of the present invention to provide a can opener that can be manipulated by someone who is physically challenged.

It is another object of the present invention to provide an automatic can opener that can automatically set a can with respect to a can-opening knife without requiring the user to either manipulate the can or contact the blade.

SUMMARY OF THE INVENTION

These, and other, objects are achieved by an automatic can opener comprising a housing having a top end and a bottom end in the set-up configuration, a can-supporting unit located near the bottom end of the housing and including a can-supporting platform having a plurality of suction cups thereon, a lift mechanism located between the can-supporting platform and the bottom end of the housing, the can-supporting platform being movably connected to the housing having a lift mechanism for moving the can-supporting platform between a first location and adjacent to the bottom end of the housing and a second location spaced apart from the first location toward the top end of the housing, and a rotating mechanism for rotating the can-supporting platform about a vertically oriented longitudinal axis, and a control button on the top end of the housing and connected to the lift mechanism and to a power source and activating the lift mechanism when the control button is in an ON configuration; a can opener unit in the housing adjacent to the top end of the housing and having a fixed can-opening knife thereon.

The can opener of the present invention requires only that the user place the can to be opened into the can opener and press a start button. The can opener does the rest. The can opener moves the can up against a can-opening blade while rotating the platform in order for the fixed blade to open the can. Upon detection of completion of opening of the can by a sensor, the can-supporting platform automatically stops rotating and returns to the first location adjacent to the bottom end of the housing. The user then only has to remove the opened can from the device of the present invention. The user does not have to manipulate the can or the can opener, nor does the user have to locate the can-opening blade by touch. The can opener of the present invention is thus safe and easy to manipulate.

DETAILED DESCRIPTION OF THE INVENTION

Figure 1:
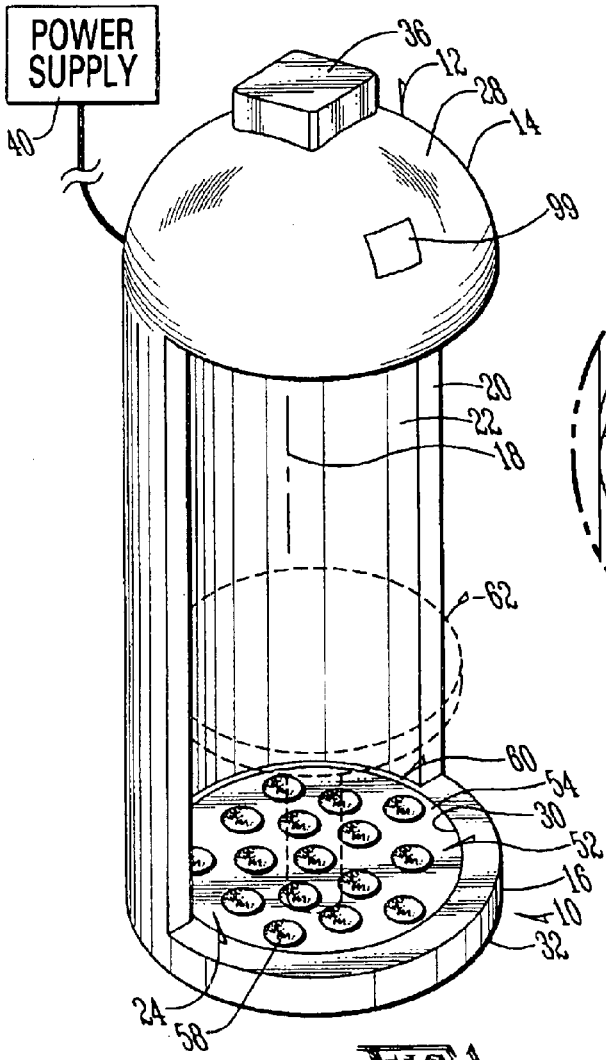
FIG. 1 is a front perspective view of an automatic can opener embodying the teaching of the present invention.
Figure 2:
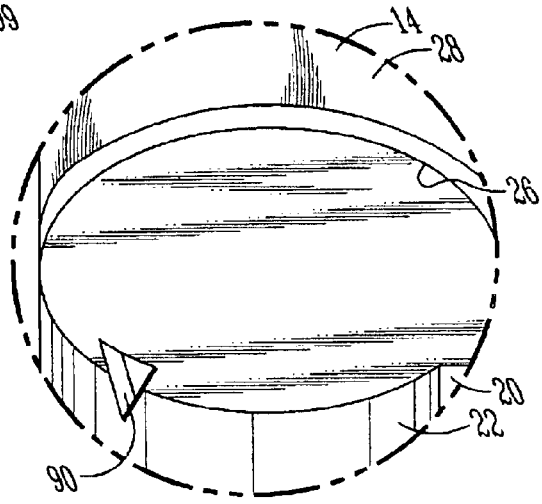
FIG. 2 is a perspective view of a can-opening blade of the automatic can opener of the present invention.
Figure 3:
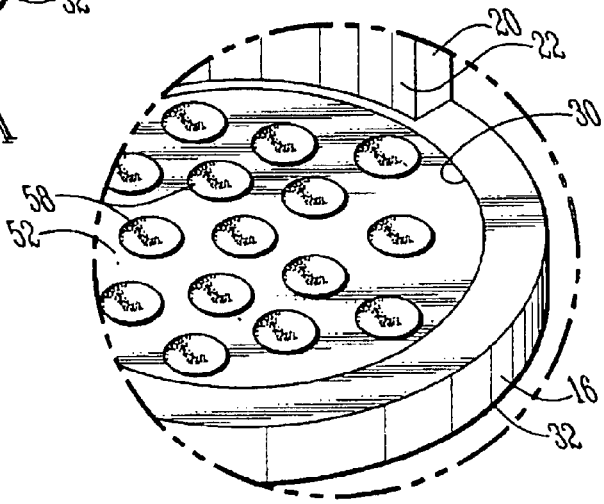
FIG. 3 is a perspective view of a can-supporting unit of the automatic can opener of the present invention.
Figure 4:
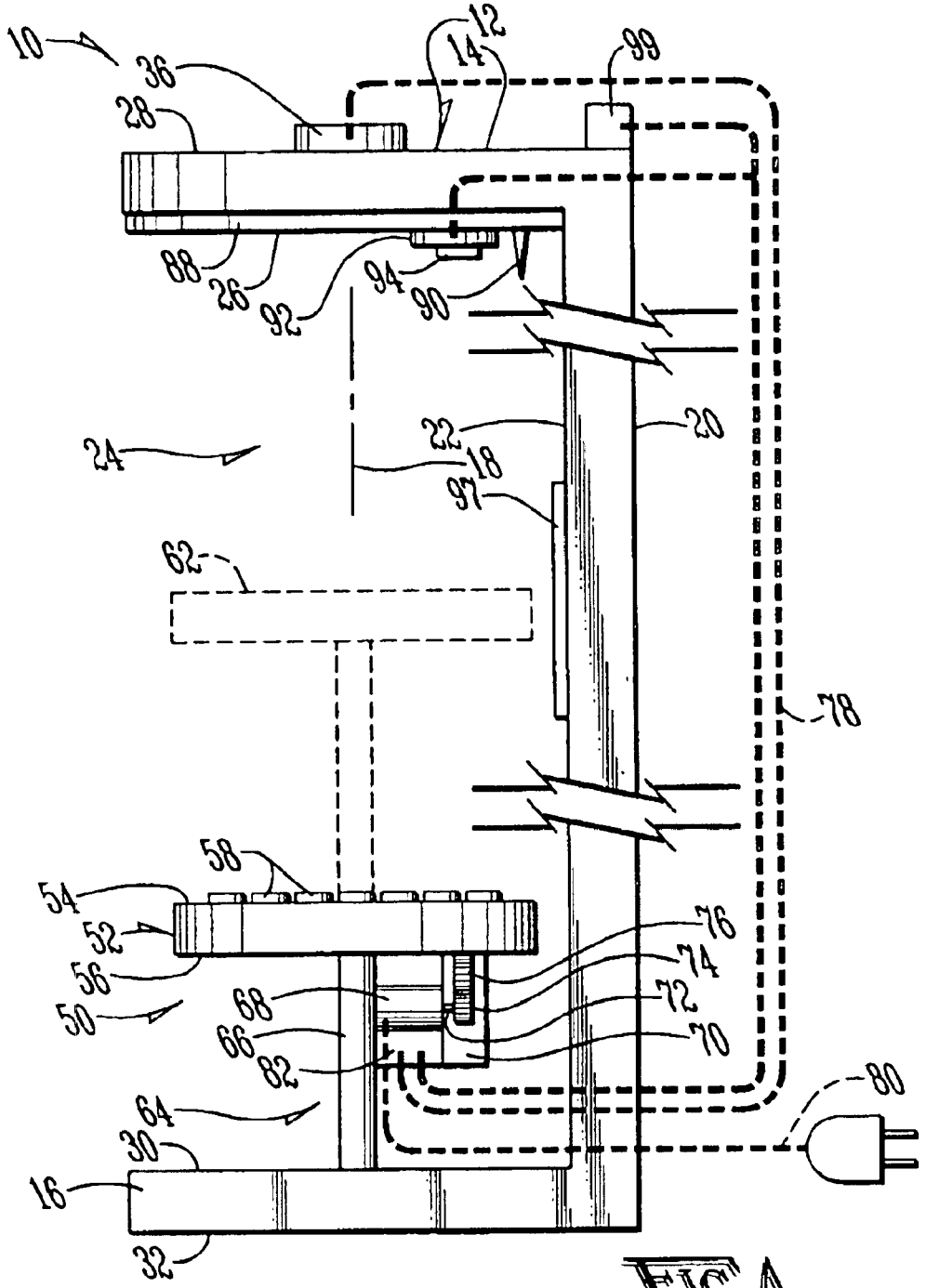
FIG. 4 is a schematic side elevational view of the automatic can opener of the present invention.

Other objects, features and advantages of the invention will become apparent from a consideration of the following detailed description and the accompanying drawings.

The automatic can opener of the present invention permits a user to simply place a can to be opened in the can opener, turn on a switch and then wait for the can opener to signal that the can has been opened, and then simply remove the opened can from the can opener. No manipulation of the can or the opener is required and the location of the can-opening blade is situated such that the user need not worry about where that blade is located relative to the can to be opened.

Referring to the Figures, an automatic can opener 10 embodying the teaching of the present invention comprises a housing 12 which includes a first end 14, a second end 16, a longitudinal axis 18 extending between first end 14 and second end 16, a sidewall 20 connecting first end 14 and second end 16 and having an inner surface 22. Housing 12 can be formed of suitable plastics-type materials and can be mounted on a wall or positioned on a countertop as desired. Housing 12 further includes an access opening 24 defined through sidewall 20 and through which a can to be opened will be moved to open the can and to remove the opened can, an interior surface 26 on first end 14, an exterior surface 28 on first end 14, an interior surface 30 on second end 16, and an exterior surface 32 on second end 16.

Housing 12 further includes an ON/OFF switch 36 on exterior surface 28 of first end 14 of housing 12 and which is electrically connected to a source of power 40. ON/OFF switch 36 is very large so a user with a sight-impairment can easily find and identify switch 36. Switch 36 is preferably rectangular in shape so it can be easily identified.

Automatic can opener 10 further comprises a can-supporting unit 50 in housing 12 which includes a platform 52 located inside housing 12 and having a first surface 54, a second surface 56, and a plurality of suction cups, such as suction cup 58, on first surface 54 of platform 52 of can-supporting unit 50. Platform 52 is movable in housing 12 between a first position, indicated in full lines in FIG. 1 indicated by numeral 60, adjacent to second end 16 of housing 12 and a second position, indicated in dotted lines designated by numeral 62 in FIG. 1, closer to first end 14 of housing 12 than the first position 60 for a purpose that will be understood from the teaching of this disclosure.

Automatic can opener 10 further includes a platform-moving unit 64 which is mounted on interior surface 30 of second end 16 of housing 12 and is interposed between platform 52 and interior surface 30 of housing 12. Platform-moving unit 64 includes a lift mechanism 66 for moving platform 52 between the first position 60 and the second position 62, the lift mechanism 66 being hydraulically operated or having other suitable arrangement. Platform-moving unit 64 includes a drive motor 68 mounted between platform 52 and interior surface 30 of housing 12. Drive motor 68 operatively causes lift mechanism 66 to move the platform 52 between the first position 60 and the second position 62.

The platform-moving unit 64 also includes a rotating mechanism 70 whereby drive motor 68 operatively causes platform 52 to be rotated about the longitudinal axis 18. The rotating mechanism 70 includes an output shaft 72 of drive motor 68, an output gear 74 on output shaft 72 of drive motor 68, and a driven gear 76 connected to the platform 52, wherein the driven gear 76 is engaged with output gear 74 on output shaft 72 of drive motor 68 to rotate platform 52 about longitudinal axis 18.

An electrical connection 78 between drive motor 68 of platform-moving unit 64 and ON/OFF switch 36 of housing 12 electrically connects drive motor 68 to power source 40 when ON/OFF switch 36 is in an ON condition to activate drive motor 68. A power cord 80 connects drive motor 68 to power source 40 to complete the circuit.

Automatic can opener 10 further includes a can-opening unit 88, which includes can-opening cutter blade 90 fixedly mounted adjacent to interior surface 26, a can-abutting element 92 also mounted adjacent to interior surface 26 of first end 14 of housing 12 adjacent to can-opening cutter blade 90, and a can sensor 94 of can-abutting element 92, which is electronically connected to control mechanism 82. Can sensor 94 generates an abutment signal when a can that is being opened has been moved from the first position 60 to the second position 62 when the can abuts the abutting element 92. Upon receipt of the abutment signal, control mechanism 82 deactivates lift mechanism 66 but does not then deactivate rotation of platform 52 as hereinafter described. This arrangement permits can opener 10 to automatically begin opening a can as soon as the can is in the second position 62 and is engaged with can-opening cutter blade 90 without further action by a user.

A rotation sensor arrangement 97 generates a rotation signal after platform 52 has made a complete rotation about longitudinal axis 18 after the abutment signal has been generated. Rotation sensor 97 can be a proximity sensor, as can the other sensors discussed in this disclosure. Proximity sensors are disclosed in standard textbooks, such as *Transducers, Sensors, and Detectors* by Robert G. Seippel, and published in 1983 by Reston Publishing Company, Inc (ISBN 0-8359-7797-8), in Chapter Six thereof, the disclosure of which is incorporated herein by reference. Other types of sensors will occur to those skilled in the art based on the teaching of the present disclosure.

Upon receipt of the rotation signal, control mechanism 82 responsively causes drive motor 68 of platform-moving unit 64, to stop rotating platform 52 and causes drive motor 68 and lift mechanism 66 to return platform 52 to the first position 60 adjacent to second end 16 of housing 12.

Also, after a short delay after receipt of the rotation signal, control mechanism 82 causes an audible signal generator 99, mounted on housing 12, to emit an audible signal after platform 52 has completed a complete rotation about longitudinal axis 18 and the platform 52 has been returned to the first position 60. Signal generator 99 can emit a chirp signal or the like and will include circuits commonly known in the art to effect the audible signal upon receipt of the rotation signal by control mechanism 82. The audible signal from signal generator 99 alerts the user that the can has been opened and is ready to be removed from automatic can opener 10. Automatic can opener 10 is sized to accommodate any size can.

Control mechanism 82 is connected to ON/OFF switch 36 which re-activates control mechanism 82 when ON/OFF switch 36 is in an OFF configuration. This permits the automatic can opener 10 to be reset for reuse on another can after a can has been opened.

It is understood that while certain forms of the present invention have been illustrated and described herein, it is not to be limited to the specific forms or arrangements of parts described and shown.

What is desired to be covered by Letters Patent is:

1. An automatic can opener comprising:

a) a housing having a top end and a bottom end in the set up configuration;

b) a can-supporting unit located near the bottom end of said housing and including (1) a can-supporting platform having a plurality of suction cups thereon, (2) a lift mechanism located between the can-supporting platform and the bottom end of said housing, (3) the can-supporting platform being movably connected to said housing to move between a first location adjacent to the bottom end of said housing and a second location spaced apart from the first location toward the top end of said housing followed by the can-supporting platform being rotated a complete rotation about a longitudinal axis of the can-supporting platform after the platform has been moved from the first position to the second position, and (4) a control button on the top end of said housing and connected to the lift mechanism and to a power source and activating the lift mechanism when the control button is in an ON configuration;

c) a can opener unit in said housing adjacent to the top end of said housing and having a fixed can-opening blade thereon.

2. An automatic can opener comprising:

a) a housing which includes
(1) a first end,
(2) a second end,
(3) a longitudinal axis extending between the first end and the second end,
(4) a sidewall connecting the first end and the second end and having an inner surface,
(5) an access opening defined through the sidewall,
(6) an interior surface on the first end,
(7) an exterior surface on the first end,
(8) an interior surface on the second end,
(9) an exterior surface on the second end,
(10) an ON/OFF switch on the exterior surface of the first end of said housing and which is electrically connected to a source of power;

b) a can-supporting unit in said housing which includes
(1) a platform located inside said housing and having
(A) a first surface,
(B) a second surface,
(C) a plurality of suction cups on the first surface of the platform of said can-supporting unit,
(D) the platform being movable in said housing between a first position adjacent to the second end of said housing and a second position closer to the first end of said housing than the first position, said platform also being rotatable about the longitudinal axis, and
(2) a platform-moving unit which
(A) is mounted between the platform and the interior surface of the second end of said housing, and
(B) which includes
(I) a drive motor,
(ii) a lift mechanism activatable by said drive motor and configured to move the platform between said first position and said second position,
(iii) a rotating mechanism including
(a) an output shaft on the drive motor,
(b) an output gear on the output shaft of the drive motor, and
(c) a driven gear connected to the platform, the driven gear engaged with the output gear on the output shaft of the drive motor to rotate the platform about the longitudinal axis,
(iv) an electrical connection between the drive motor of the platform-moving unit and the ON/OFF switch of said housing, which electrically connects the drive motor to the source of power when the ON/OFF switch is in an ON condition to activate the drive motor of the platform-moving unit,
(v) a control mechanism which
(a) deactivates the lift mechanism after the platform is moved to the second position from the first position, and
(b) after the lifting mechanism has moved the platform from the first position to the second position and after the rotating mechanism has rotated the platform a complete rotation about the longitudinal axis, causes the lift mechanism and drive motor to return the platform of said can-supporting unit back to the first position adjacent to the second end of said housing,
(vi) an electrical connection between the control mechanism and the ON/OFF switch which deactivates the control mechanism when the ON/OFF switch is in an OFF configuration;

c) a can-opening unit which includes
(1) a can-opening cutter blade fixedly mounted on the interior surface of said first end of said housing,
(2) a can-abutting element mounted on the interior surface of said first end of said housing adjacent to the can-opening cutter blade,
(3) a can sensor in the can-abutting element of said can-opening unit which is electronically connected to the control mechanism and which generates an abutment signal when a can abuts the can-abutting element of said can-opening unit,
(4) a rotation sensor which generates a rotation signal when the rotating mechanism has rotated the platform a complete rotation about the longitudinal axis after the lift mechanism has moved a can from the first position to the second position,
(5) a signal receiver
(A) to receive the abutment signal from the can sensor and to cause the control mechanism to de-activate the lift mechanism of said platform-moving unit when the abutment signal is received from the can sensor in the can-abutting element, and
(B) to receive the rotation signal from the rotation sensor and to cause the drive motor and lift mechanism to return the platform to the first position adjacent to the second end of the housing, and
(6) an audible signal generator mounted on said housing which includes a signal receiver which receives the signal generated by the rotation sensor and which emits an audible signal after the platform has been rotated a complete rotation about the longitudinal axis and after the platform has been moved from the second position back to the first position.

3. The automatic can opener as described in claim 2, wherein the lift mechanism is hydraulically operated.

* * * * *